US005381628A

United States Patent [19]

D'Hooge

[11] Patent Number: 5,381,628

[45] Date of Patent: Jan. 17, 1995

[54] DOOR HOLDER/DOOR STOP

[75] Inventor: Richard D'Hooge, Wood Dale, Ill.

[73] Assignee: Architectural Builders Hardware Mfg. Inc., Elk Grove Village, Ill.

[21] Appl. No.: 181,216

[22] Filed: Jan. 13, 1994

[51] Int. Cl.[6] ..... E05C 17/00

[52] U.S. Cl. ..... 49/394; 16/49

[58] Field of Search ..... 49/394; 16/49, 82

[56] References Cited

U.S. PATENT DOCUMENTS

| | | | |
|---|---|---|---|
| 2,942,291 | 6/1960 | Flint | 16/49 |
| 2,960,718 | 11/1960 | Lasier | 16/49 |
| 3,771,823 | 11/1973 | Schnarr | 16/49 X |
| 3,877,108 | 4/1975 | Del Fiacco | 16/49 |
| 3,986,742 | 10/1976 | Heaney | 16/49 X |

*Primary Examiner*—Jerry Redman

[57] ABSTRACT

A door holder/stop for attachment between a door and a door frame has an elongate first and second arms attached with one end of the first arm overlapping a portion of the second arm to provide a single adjustable length arm. To join the ends of the first and second arms to each other in overlapping relationship, one of the elongate arms has a transverse hole near the second end thereof and a longitudinal slot extending through a portion of the length with one end of the slot positioned a short distance from the transverse hole. The other of the elongate arms has a plurality of threaded holes spaced along the length thereof. A first threaded screw is passed through the transverse hole of the one arm and into one of the threaded holes of the other arm, and a second threaded screw is passed through the slot of the one arm and into a second threaded hole in the other arm.

5 Claims, 2 Drawing Sheets

DOOR HOLDER/DOOR STOP

The present invention relates to devices for holding a door in an open position and, in particular, to door holders/stops i.e., check assemblies with an arm that adjusts to lengths suitable for the door to which it is attached.

BACKGROUND OF THE INVENTION

It is frequently desirable to retain a door in a fixed orientation such as an open position, and door holders/-stops are available having an arm which extends between a door and the associated door frame to retain the door in an open or stop position. As the door is opened, one end of the arm slides longitudinally within a track parallel to the floor and secured to either the door or the door frame. Such door holders have a releasable latch which can lock the sliding portion of the holder in a fixed position on the track to retain the door in the desired open or stop position, thereby preventing closing and excessive opening of the door.

SUMMARY OF THE INVENTION

Briefly, the present invention is embodied in a door holder/stop for attachment between a door and a door frame. The device has an elongate first arm, the first end of which is pivotally attached to a portion of a door frame. The second end of the first arm is attached to the second end of a second elongate arm in overlapping relationship to form a single adjustable length arm. The first end of the second arm is pivotally connected to a slide which is movable along a track fitted against the door. A thumb wheel positioned in the track can be turned to lock the slide against movement and thereby lock the door in an open position.

To join the second ends of the first and second arms to each other in overlapping relationship, one of the elongate arms has a transverse hole near the second end thereof and a longitudinal slot extending through a portion of the length with one end of the slot positioned a short distance from the transverse hole. The other of the elongate arms has a plurality of threaded holes spaced along the length thereof. To attach the second ends of the arms to each other, a first threaded screw is passed through the transverse hole of the one arm and into one of the threaded holes of the other arm, and a second threaded screw is passed through the slot of the one arm and into a second threaded hole in the other arm.

GENERAL DESCRIPTION OF THE DRAWINGS

A better and more complete understanding of the present invention may be had by a reading of the following description taken in connection with the accompanying drawings wherein.

DETAILED DESCRIPTION OF A PREFERRED EMBODIMENT

Figure 1:
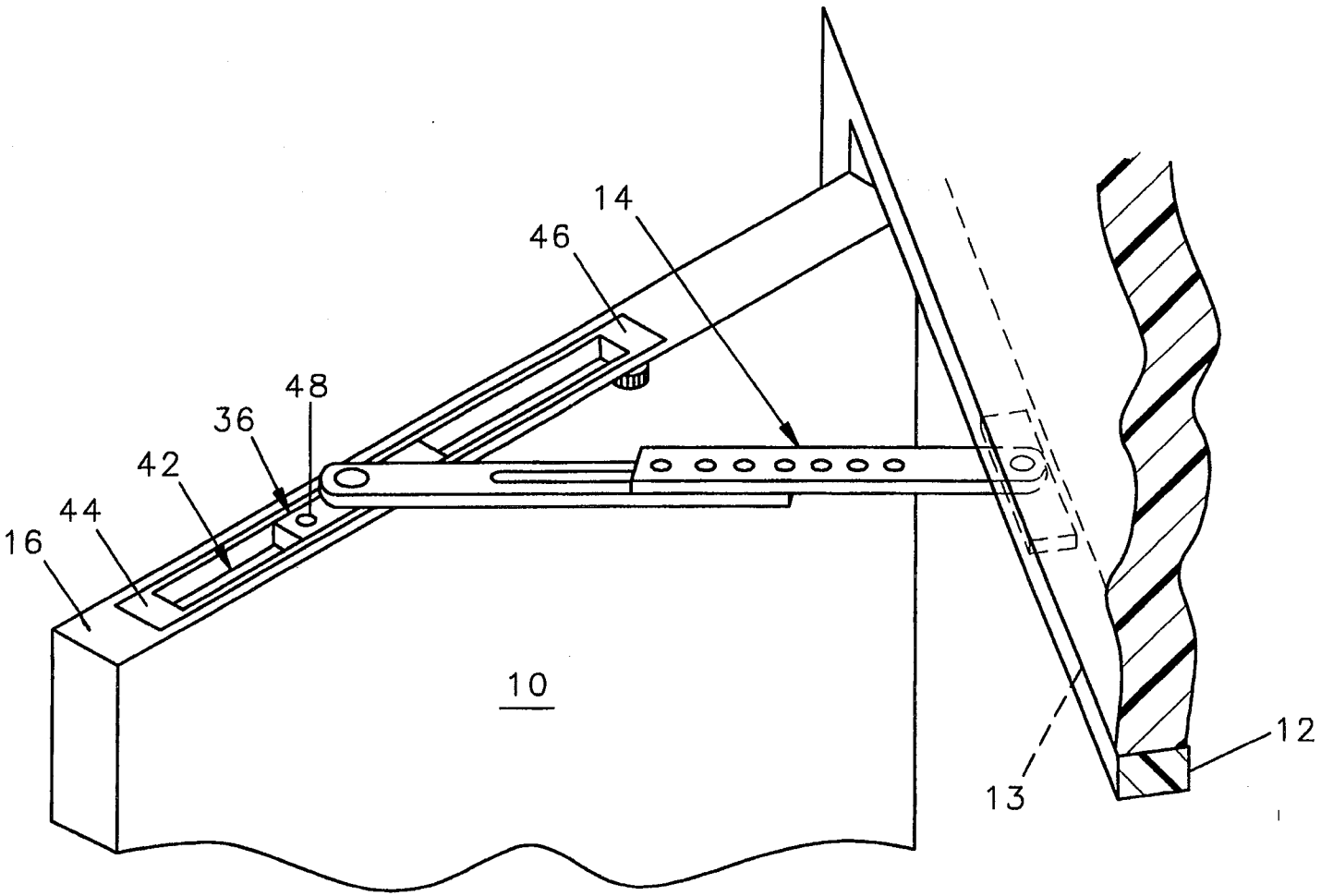
FIG. 1 is a fragmentary perspective view of a door and door frame having a door holder/stop in accordance with the present invention attached thereto and portions thereof are shown in phantom lines.

Referring to FIG. 1, a door 10 is pivoted on a plurality of hinges and closes against a door frame 12, only a portion of which is depicted. The door frame 12 includes parallel upstanding sides, not shown, and a central portion having a substantially horizontal lower surface 13 which extends across the top of the door when the door is in the closed position. A door holder/-stop 14 in accordance with the present invention extends between the upper inner edge 16 of the door 10 and the lower surface 13 of the central portion of the door frame 12.

Figure 2:
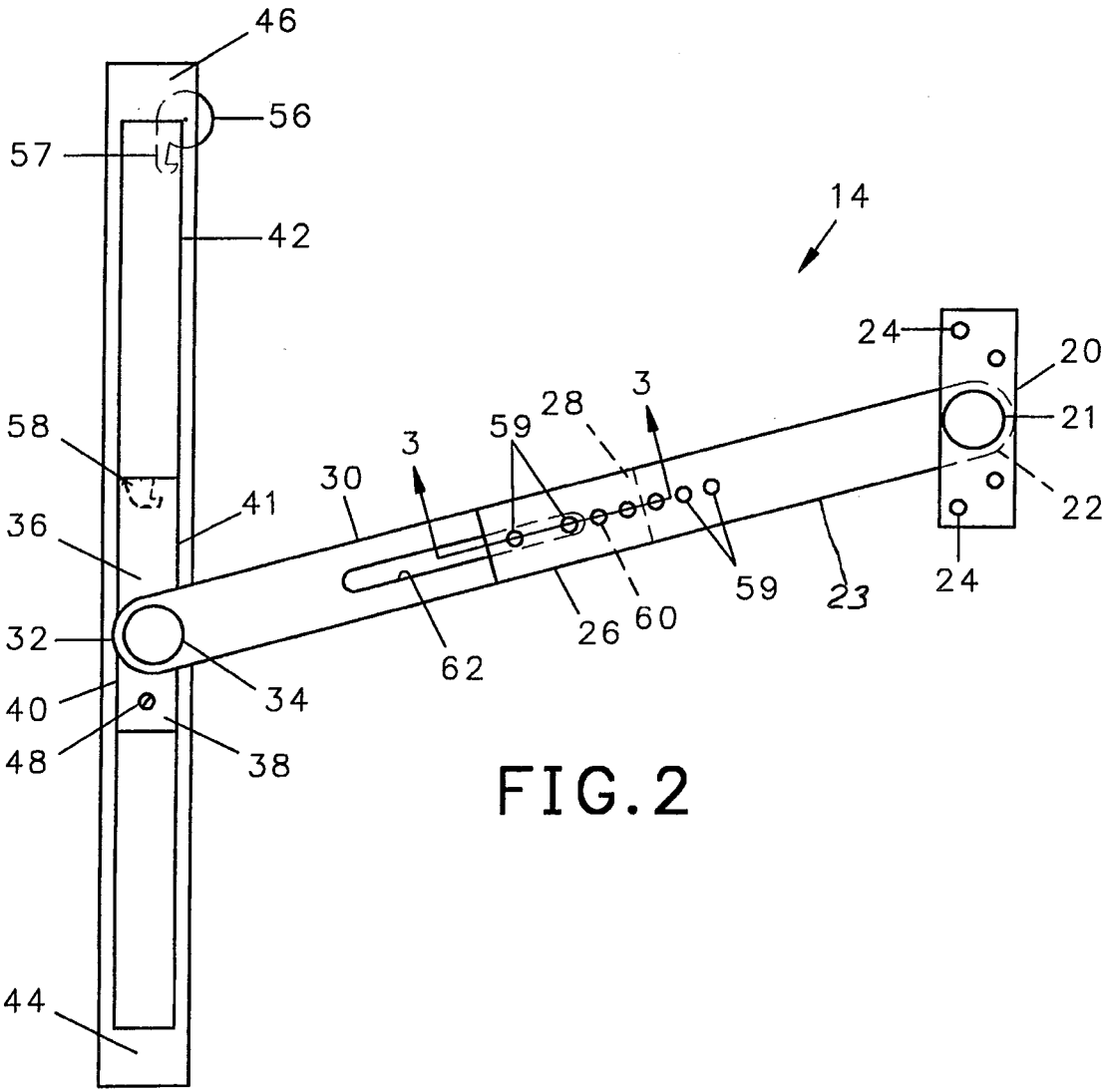
FIG. 2 is a top view of the door holder/stop shown in FIG. 1 which has been detached from a door and frame, with portions thereof shown in phantom lines.

Referring to FIG. 2 the door holder/stop 14 has a mounting plate 20 and attached by a pivot 21 to the mounting plate 20 is the first end 22 of a first arm 23. The mounting plate 20 also has a plurality of holes 24 for receiving a like number of threaded screws to retain the plate 20 against either the lower surface 13 in the center of the door frame 12 or the upper surface 16 of the door 10. In FIG. 1, the mounting plate 20 is depicted as being attached to the lower surface 13 of the door frame 12. The second end 26 of the first arm 23 is attached in overlapping relationship to the second end 28 of a second elongate arm 30. The first end 32 of the second arm 30 has a pivot 34 for pivotal attachment to a slide 36.

As shown in FIGS. 1 and 2, the slide 36 has a block shaped body with a generally rectangular upper surface 38 and rectangular side surfaces 40, 41. The slide 36 is adapted to fit within a track 42 which has a rectangular cross section for slidably receiving the slide 36, and has end portions 44, 46, respectively. A plurality of screws or the like retain the track 42 against the upper edge 16 of the door 10. A set screw 48 threaded into a vertically oriented transverse hole, not shown, extending through the body of the slide 36 can be tightened against the bottom of the track to create resistance to the movement of the slide 36 along the track 42. Tightening of the screw will increase the resistance to movement of the slide 36 and prevent the door to which it is attached from swinging freely.

A thumb wheel 56 positioned at end portion 46 of the track 42 rotates to engage or disengage a pawl 57 against a hook 58 on the slide 36. The pawl 57 and the hook 58 provide a locking means to lock the slide against further movement along the track 42.

Figure 3:
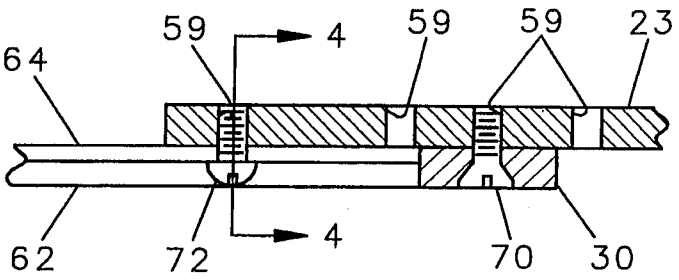
FIG. 3 is a cross-sectional view of the linkage between the first and second arms taken through line 3—3 of FIG. 2.
Figure 4:
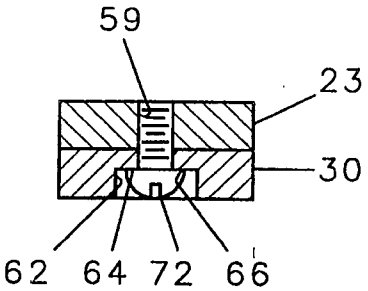
FIG. 4 is a cross-sectional view of the linkage between the first and second arms taken through line 4—4 of FIG. 3.

Referring to FIGS. 1, 2, 3 and 4, to retain the second ends 26, 28 of the first and second arms 23, 30, respectively, in overlapping end relationship, a plurality of transverse threaded holes 59—59 are spaced along a substantial portion of the length of the first arm 23 with the last threaded hole 59 positioned near the second end 26 of the first arm 23. Near the second end 28 of the second arm 30 is a transverse hole 60 and centrally located through the length of the second arm 30 is a longitudinal slot 62 one end of which is positioned near the transverse hole 60. As best shown in FIG. 4, the longitudinal slot 62 has opposing inner lips 64, 66 positioned along the sides thereof adjacent the surface which abuts against the first arm 23.

To join the second end 28 of the second arm 30 to the second end 26 of the first arm 23, a first threaded bolt 70 is fitted through the transverse holes 60 of the second arm 30 and into one of the threaded holes 59—59 of the first arm 23, and a second threaded bolt 72 is fitted through the slot 62 of the second arm 30 and into another of the threaded holes 59—59 of the first arm 23. As can be seen in FIG. 3 and 4, the opposing first and second lips 64, 66 along the sides of the slot 62 fit alongside the head of the second screw 72 to contain the screw 72 when the first and second arms 22, 30 are assembled to each other. Similarly, the transverse hole 60 near the end of the second arm 30 is countersunk and the head of the first fitted screw 70 is substantially flush with the outer surface 74 of the second arm 30.

The open position at which the door 10 is to be held relative to the door frame 12 can be adjusted by removing the screws 70, 72 from the holes in which they are fitted and moving the first and second arms 23, 30 longitudinally relative to one another and reinsetting the screws 70, 72 to thereby change the length of the combined arms 23, 30. In this manner, the door holder/stop 14 can also be adjusted for use on any door and door frame.

While the present invention has been described in connection with one embodiment, it will be appreciated by those skilled in the art that many changes and modifications can be made without departing from the true spirit and scope of the present invention. Therefore, it is intended by the appended claims to cover all such changes and modifications which come within the true scope and spirit of the invention.

What is claimed:

1. A door check assembly for attachment between a door frame and a door comprising in combination:

a first elongate arm member having a first end and a second end;

first attachment means for pivotally attaching said first end of said first arm to one of a door and a door frame;

a second elongate arm member having a first end and a second end;

second attachment means for slideable and pivotal attachment of said first end of said second arm to the other of a door and a door frame;

said second end of one of said first arm and said second arm having a plurality of threaded holes spaced along the length thereof;

said second end of the other of said first arm and said second arm having a transverse hole therethrough;

said other of said first arm and said second arm further having an elongate slot extending through a portion of the length thereof between said transverse hole and said first end thereof; and said second ends of said arms attached to each other by a first screw through said transverse hole and into one of said plurality of threaded holes and a second screw through said elongate slot and into another of said plurality of threaded holes.

2. A door check assembly in accordance with claim 1 and further comprising:

locking means for releasably locking said first end of said second arm against sliding movement along the other of a door and a door frame,

3. A door check assembly in accordance with claim 1 and further comprising:

adjustable resistance means on said second attachment means for providing frictional resistance to slideable movement of said first of said second arm along the other of a door and a door frame.

4. A door check assembly in accordance with claim 1 further comprising:

said second attachment means having an elongated track and a slide slideable along said track;

said first end of said second arm pivotally attached to said slide; and locking means for releasably locking said slide against movement along said track.

5. A door check assembly in accordance with claim 4 wherein said slot further comprises a pair of opposing lips, one of said lips positioned on each side of said slot.

* * * * *